United States Patent [19]

McDonald et al.

[11] 4,044,894

[45] Aug. 30, 1977

[54] LOAD TILTING MAGNETIC LIFT

[75] Inventors: Donald C. McDonald, Sherborn; Roger B. Ela, Spencer; Francis E. Whittaker, Holliston, all of Mass.

[73] Assignee: Walker Magnetics Group, Inc., Worcester, Mass.

[21] Appl. No.: 689,729

[22] Filed: May 25, 1976

[51] Int. Cl.[2] ..... B66C 1/04

[52] U.S. Cl. ..... 214/1 QD; 214/1 BV; 214/658; 294/65.5

[58] Field of Search ..... 214/1 QD, 1 BS, 1 BT, 214/1 BV, 8.5 D, 658; 294/65.5

[56] References Cited

U.S. PATENT DOCUMENTS 3,924,759 12/1975 Madonia ..... 214/1 BT X

FOREIGN PATENT DOCUMENTS 1,202,954 10/1965 Germany ..... 294/65.5

211,586 3/1967 Sweden ..... 294/65.5

*Primary Examiner*—Robert J. Spar

*Assistant Examiner*—George F. Abraham

*Attorney, Agent, or Firm*—Kenway & Jenney

[57] ABSTRACT

Apparatus for the magnetically lifting and tilting an elongate load, e.g., a steel beam, is disclosed. The apparatus comprises a plurality of electromagnets supported in a corresponding plurality of yokes in a linear array along a beam structure. On each yoke, a stepping motor is coupled to the respective electromagnet for controllably rotating the electromagnet around a pivotal axis which is parallel to the axis of the array. The motors are synchronously operated, thereby enabling an elongate load to be lifted by the electromagnets together and tilted around the pivotal axis. In a preferred construction, each end of each yoke is suspended on a plurality of tie elements connected to a vertically compliant spring suspension system mounted on the beam structure. The tie elements are arranged to minimize swinging or misalignment of the several electromagnetic lifting elements.

15 Claims, 4 Drawing Figures

LOAD TILTING MAGNETIC LIFT

BACKGROUND OF THE INVENTION

This invention relates to an electromagnetic lifting apparatus, and more particularly to such an apparatus which is capable of tilting or rotating an elongate load about its longitudinal axis.

In many industries which utilize elongate structural steel, such as channels, angles, and I beams, it is frequently necessary to provide access to all surfaces of the steel so as to enable a workman to paint a surface, drill holes, or perform other tasks. This has been accomplished by lifts which electromagnetically engage the elongate load, raise it to a level suitable for the work, and rotate it about its longitudinal axis so as to expose a selected surface. Typically, such lifts comprise an array of lifting elements having electromagnets mounted for rotation about aligned axes and a bipolar or quadrapolar electric motor coupled to each rotatable magnet by a system of pulleys. In order to realize the full lifting potential of the electromagnets, it is essential that their pole pieces be oriented parallel with the surface of the load to be lifted so as to provide a good flux path. If, because of stretching of the pulleys or other reasons, all the pole pieces of each magnet do not contact the surface of the load to be lifted, the total lifting potential of the apparatus is unrealized. In addition, many elongate structures become slightly warped or twisted, and thus, even if all the pole pieces of the electromagnets remain in proper alignment in a single plane, the desired contact between pole pieces and load is not realized because of these surface irregularities.

Another problem with these prior art devices results from the difficulty of synchronizing the rotation of the individual electromagents. Unless each is synchronized with the others so that all the magnets will rotate to the same degree simultaneously, the apparatus cannot utilize the total amount of torque available for tilting. In this circumstance, some magnets may bear a larger share of the load than others, leading to an ineffective use of the available holding power. Thus, if a single, large motor is used as in certain prior art systems, complicated and expensive means for equally distributing the rotation to the separate magnets must be provided.

SUMMARY OF THE INVENTION

Accordingly, it is an object of the present invention to overcome the described drawbacks of the prior art load tilting, lifting devices. It is a further object to provide a simple, reliable, and relatively inexpensive apparatus of the type described in which optimum contact is made between the pole pieces of the electromagnets and the surface of the elongate load being lifted, even when the load is twisted or warped. Another object of the invention is to provide such an apparatus wherein the torque necessary to tilt the elongate load is provided by a series of motors which are easily synchronized and which supply torque equally.

In general, the invention features a magnetic lifting apparatus comprising an extended beam structure and a plurality of suspended lifting elements. Each lifting element hangs from a pair of vertically complaint spring suspension systems on a plurality of tie elements, skew with respect with each other, which support the lifting elements in a manner designed to minimize sway and misalignment. Each lifting element comprises an electromagnet mounted for rotation on a yoke and a stepping motor coupled to the electromagnet for selectively rotating it about an axis essentially parallel to the beam structure. Means are provided for energizing the motors for synchronous operation. Each electromagnet has a brake which is automatically applied when its stepping motor is not in operation. Means are provided for simultaneously and momentarily disengaging the brakes after the magnets have engaged a load. This permits momentary nonsynchronous rotation of the electromagnets and accomodates initial misalignment of the individual lifting elements by allowing each electromagnet to conform to the surface of the load. Further, means are provided for automatically applying the brakes when the combined torque output of the motors is insufficient to rotate the load against the force of gravity or when, during a downward rotation, the torque exerted by the load overruns the motors.

Other advantages and features of the invention will be apparent from the following description of a preferred embodiment and from the drawing.

BRIEF DESCRIPTION OF THE DRAWING

Corresponding Reference characters indicate corresponding parts throughout the several views shown in the drawing.

DESCRIPTION OF THE PREFERRED EMBODIMENT

Figure 1:
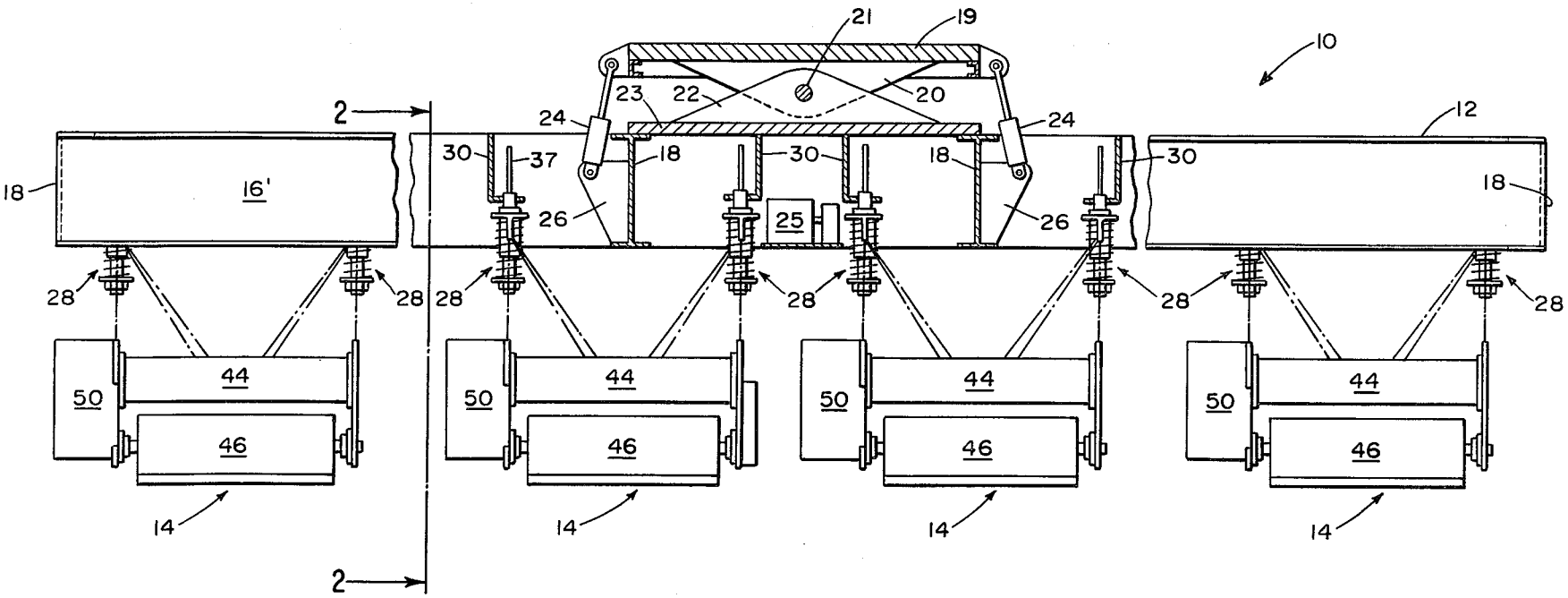
FIG. 1 is a partially broken-away front elevation of a magnetic lift assembly embodying features of the invention.
Figure 2:
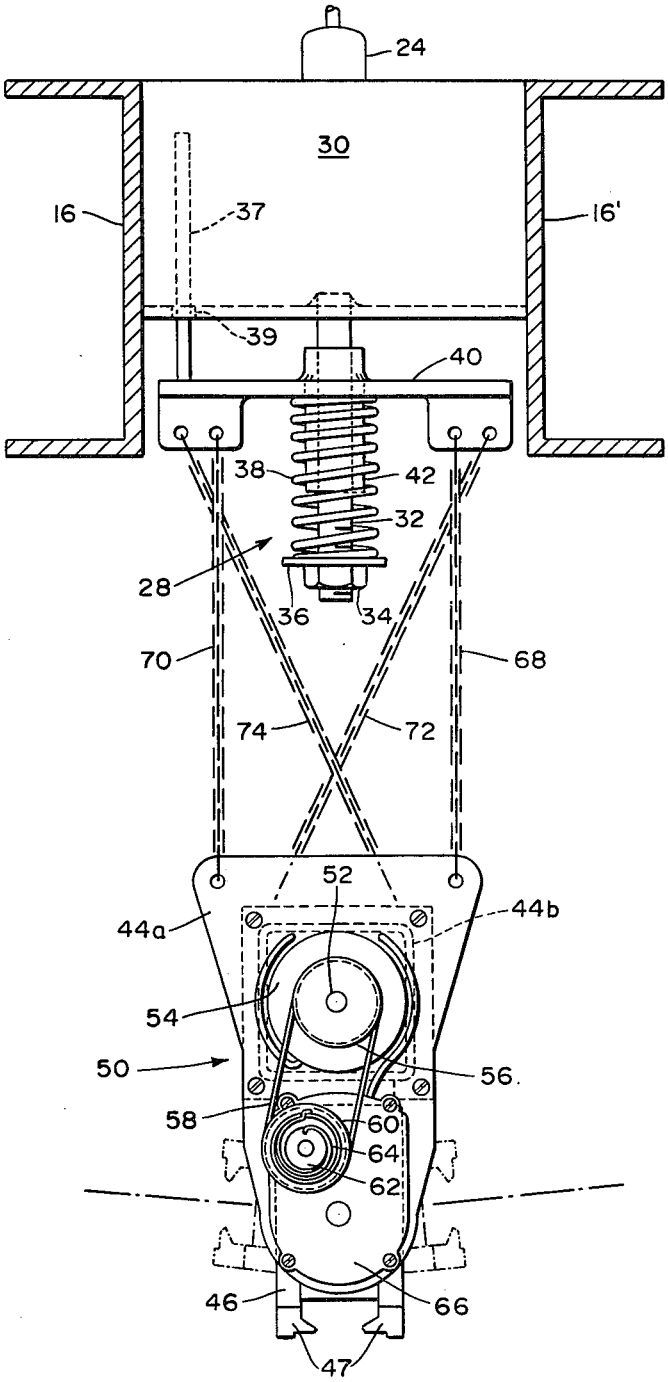
FIG. 2 is an enlarged view taken at 2—2 of FIG. 1.

Referring to the drawing, a lifting apparatus 10 is shown which comprises an extended beam structure 12 which supports a plurality of suspended lifting elements 14. The beam structure 12, as seen in FIG. 2, comprises a pair of steel U beams 16, 16' arranged back-to-back and rigidly connected by a plurality of ribs 18 welded in position therebetween.

The beam structure 12 is itself pivotally suspended from a lifting plate 19 by means of a pin 21 which pivotally connects lug 20 on plate 19 and a pair of lugs 22 secured to a plate 23 which is welded to the beam structure 12 and spans the space between U beams 16, 16'. A pair of hydraulic pistons 24, powered by a hydraulic pump and motor 25 through hydraulic conduits (not shown), are interposed between the lateral ends of lifting plate 19 and flanges 26, which are rigidly mounted on rib member 18. As is understood in the art, when lifting plate 19 is supported on the cables of a crane (not shown), this design enables the lift operator to level the beam structure 10.

Each lifting element 14 is suspended from the beam structure 12 by means of a pair of vertically compliant spring suspension systems 28, each of which is fastened to an L-shaped support 30, welded between the U beams 16, 16'. Each suspension system comprises a vertical rod 32 extending downwardly from a respective support 30 through a coil spring 38, and a tie lug 40. The lower end of the rod 32 is threaded to receive nut 34 which carries a spring support washer 36. The coil spring 38 rests on the support washer 36 in axial alignment with rod 32 and resiliently supports the tie lug 40.

Figure 3:
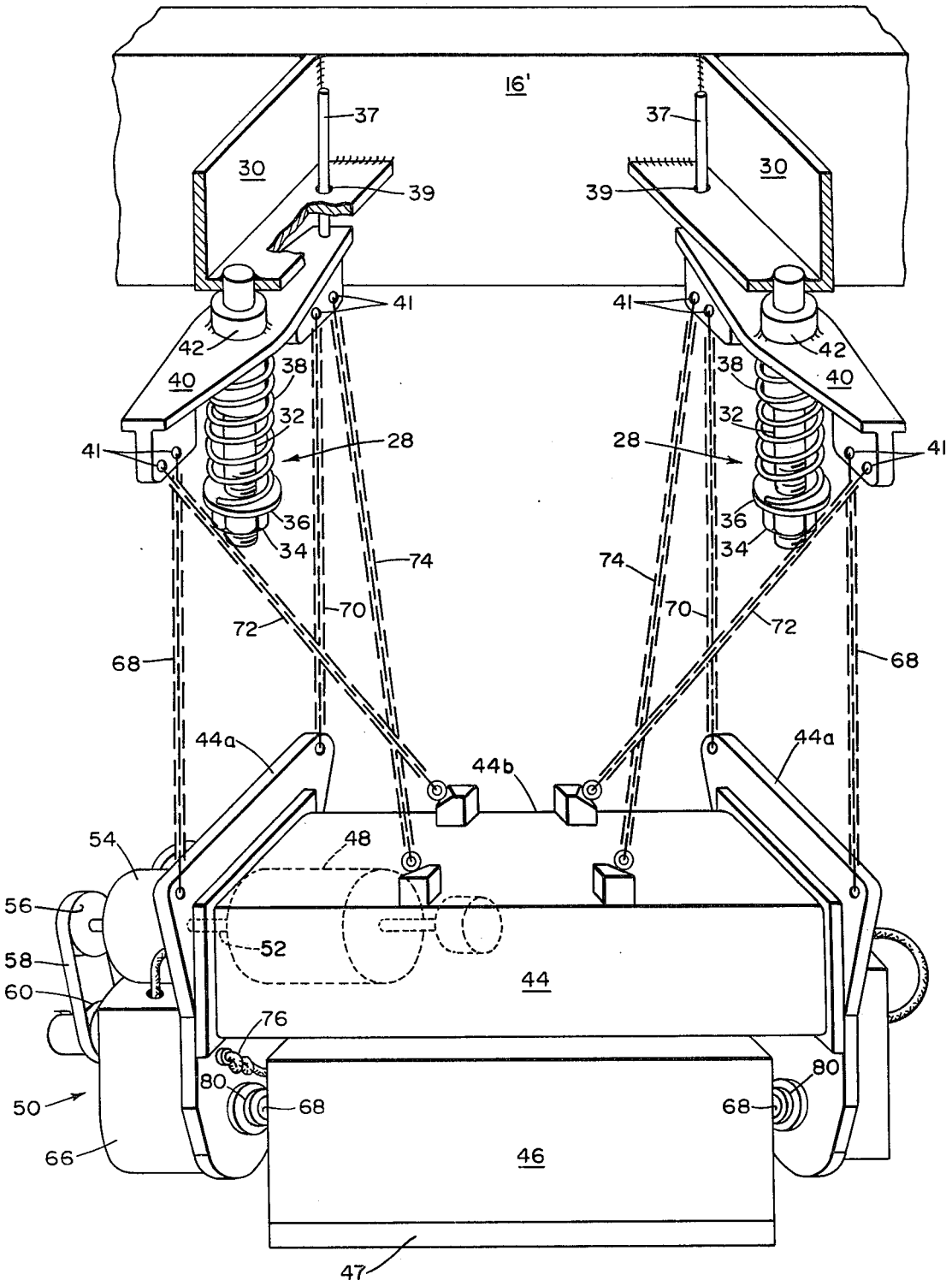
FIG. 3 is an enlarged, exaggerated perspective view of a lifting element of the assembly of FIG. 1 showing some parts in phantom.

A sleeve 42, integral with the tie lug 40, serves as a bearing for vertical movement of the tie lug and prevents axial misalignment of the spring 38 on the rod 32. A shaft 37, mounted on tie lug 40 adjacent one end thereof, passes through a hole 39 in the horizontal part of support 30 and serves to maintain the tie lug in its orientation normal to the axis of the beam lift structure 12. As shown in FIG. 3, at each end of each tie lug 40, a pair of bores 41 are positioned to receive tie elements, preferably chains 68, 70, 72, and 74, which, as explained more fully below, are arranged to stabilize the lifting elements 14.

Each lifting element 14 comprises a yoke 44, consisting of end plate 44*a* and integral cross piece 44*b*, a bipolar electromagnet 46, a stepping motor 48, and a power transmission control means 50.

The stepping motors 48 are permanent magnet, synchronous AC motors available commercially under the tradename SLO-SYN. They are designed for constant speed operation, are multipolar, have rapid starting, stopping, and reversing characteristics, and have a shaft speed synchronous with line frequency when energized with standard 60 cps line current. Each stepping motor 48 has a drive shaft 52 which extends through an electrically operated feed-through mechanical brake 54 and terminates at a drive pulley 56. The brake is of the conventional type of construction which is engaged by a spring and released by energization of an electric solenoid. A timing belt 58 is entrained around drive pulley 56 and driven pulley 60. Driven pulley 60 is resiliently coupled to a disc 62, mounted coaxially therewith, by a clock torsion spring 64. This spring provides a compliance which isolates the stepping motor 48 from the inertial load thereby reducing the torque that would otherwise be necessary to rapidly accelerate the load. Thus, stalling tendency of the motor during start-up is minimized. This compliance also causes the torque required of all motors to be essentially equal, i.e., to effect torque-sharing. A pair of opposed springs may also be used for this purpose. Torque applied on disc 62 through the clock spring 64 is transferred through gear box 66 and applied to rotate electromagnet 46 through power outlet shaft 68 (see FIG. 3). The gearing ratio in gear box 66, as will be understood in the art, may be selected to suit the power of the motor 48 and to apply the maximum torque desired on magnets 46.

The bipolar electromagnet 46 of each lifting element may be of a type generally used in the art. Preferably, each magnet has shoes 47, such as those seen in FIG. 2, which are capable of handling angled, channelled, and wide flange structural steel. The magnets are mounted in bearings 80 in the respective yoke end plates 44*a*. This mounting permits the magnets to rotate about their longitudinal axis, i.e., aligned axes paralled with that of beam structure 12. Each magnet can rotate about 110° in either direction from vertical before encountering a fixed stop (not shown). Limit switches are provided for sensing when a load has been rotated about 100° from vertical. The limit switches are provided on one of the yokes only, preferably, one near the center of the array.

As seen in FIG. 3, each end of the yoke 44 is suspended on four tie elements 68, 70, 72, and 74, arranged to stabilize the lifting element 14. Tie elements 68 and 70, in accordance with this goal, are connected to the front and back of the yoke end plates 44*a*. With this arrangement, the center of gravity of the lifting element when carrying a load will necessarily lie at a point between tie elements 68, 70 and below their point of attachment on the yoke. Thus, rotation of the yoke about a horizontal axis is minimized or eliminated when the load is rotated by magnets 46. To reduce swaying of the lifting element, tie elements 72 and 74 are secured to yoke cross piece 44*b* and skewed with respect to each other and with respect to the pair of vertical tie elements 68 and 70. When each yoke is elongate in the direction of the electromagnet's axis of rotation as shown, the tie elements 68, 70 and one of the tie elements 72 and 74 together provide a three dimensional skewed support network which reduces swinging and misalignment of the lifting elements.

Figure 4:
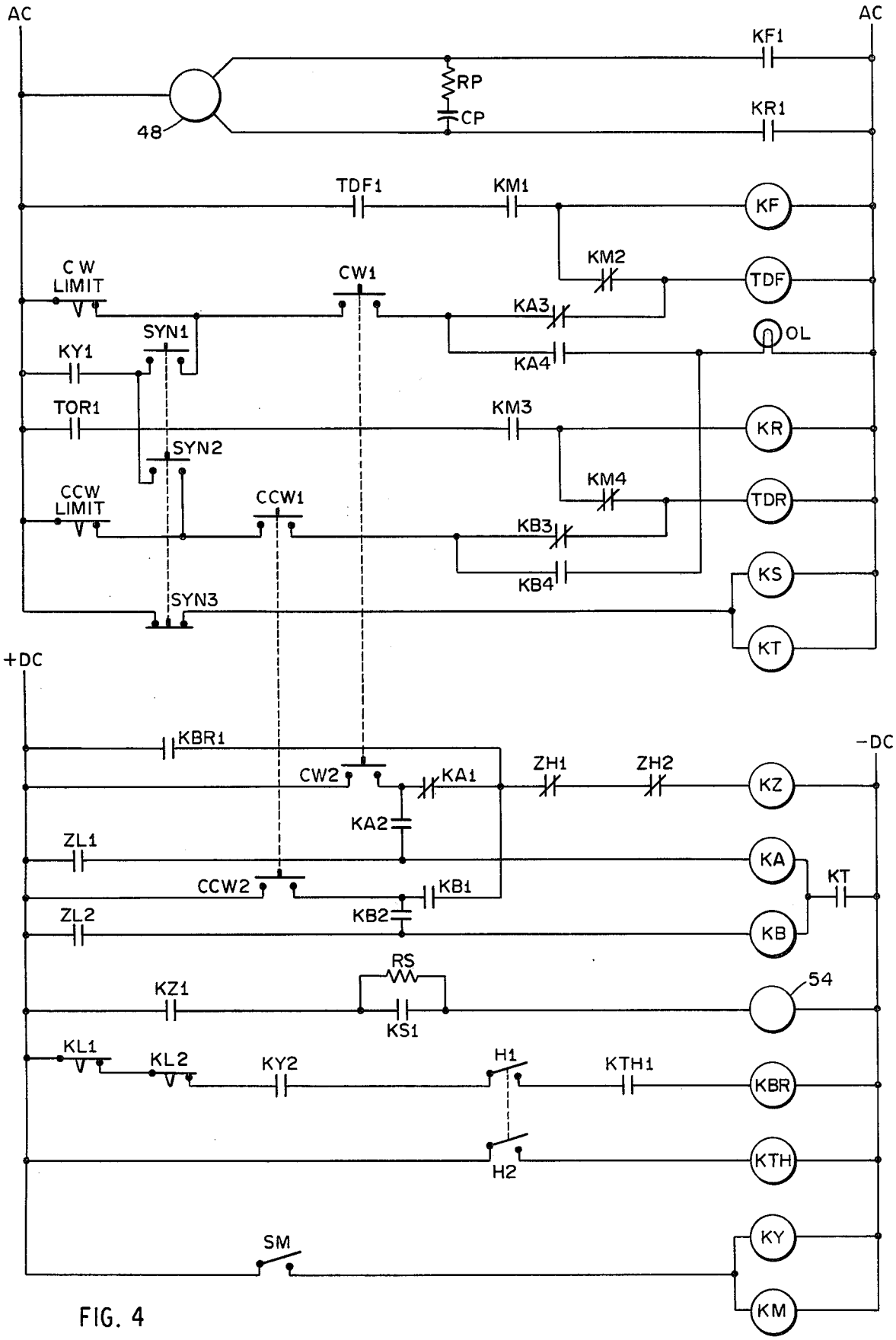
FIG. 4 is a schematic circuit diagram of circuitry for controlling the lift assembly of FIG. 1.

The circuitry for controlling the operation of the stepping motors in conjunction with the selective energization of the lifting magnets and the hoist apparatus is illustrated in FIG. 4. This circuit diagram is laid out in conventional industrial form with the electrical loads, largely represented by circles, being arranged along the right hand side of the diagram. Relay contacts are designated by a pair of parallel lines for normally-open contacts and similar parallel lines with a diagonal crossing line for normally-closed relay contacts. The electrical loads, e.g., relay windings and timers, are given mnemonic letter designations. Contacts controlled by a given relay coil are given the same letter designation as the coil, followed by a numeral postscript permitting the several different contact sets controlled by a single coil to be discriminated. Both a.c. and d.c. supply leads are employed as indicated, the stepping motors being energized with alternating current at standard line frequency, i.e., 60 cps. Direct current is provided for energizing the magnet and some of the related control circuitry, again in conventional manner.

Each two-phase stepping motor 48 is provided with a phase shifting network consisting of a capacitor CP and a limiting resistor RP which determines the direction of rotation of the motor. Each motor can be energized to rotate in a clockwise direction through a set of contacts KF1, or so as to rotate in a counterclockwise direction through a pair of contacts KR1. Only one motor 48 is shown in the diagram for simplicity but, from the earlier description, it will be understood that the system comprises one such motor for each of the lifting magnets and yokes.

When tilting of a load is being accomplished, it is desirable that the operation of the motors be timed in relation to the operation of the brakes 54. For this purpose, the forward and reverse relays are selectively energized through time contacts TDFl and TDRl respectively, these contacts being switched into the circuit by relay contact KM1-KM4 which are operated when relay winding KM is energized. This latter relay winding is energized upon energization of the lifting magnet, i.e. by means of a manual switch SM which also energizes the lifting magnet contactor KY. The timers TDF and TDR are of the type which operate quickly but which open only after a predetermined delay, e.g., 100 milliseconds. Thus, when clockwise rotation is called for by operation of the manual switch CW1-2, the stepping motors are immediately energized by closure of the contacts TDFl to produce rotation in a clockwise direction. Simultaneously, the switch contacts CW2 energize the relay KZ whose contacts KZ1 energize and thereby release the brakes 54. As the relay winding KS is normally energized except during operation of a synchronization switch SYN1, 2, 3, the contacts KS1 are usually closed so that the brake release winding solenoid is fully energized. Upon release of the manual control switch CW1, 2, the brakes are re-applied. Any delay in the operation of the brakes is compensated for by the delay provided by the timer TDF so that the load will not be released by de-energization of the motor before the brake can take control. Rotation in the opposite direction, called for by a manual operation of the switch CCW1-2, is provided in a similar manner under control of the time TDR.

In order to sense situations in which the load may overpower the motor, e.g. when the operator may have stopped a load part way up and the motor has insufficient torque to again start rotating the load, the apparatus provides speedsensing switches ZL1 and ZL2, ZH1 and ZH2 associated with a representative one of the motors. The switches are of the type which are sensitive to the direction of rotation. The switches ZH1 and ZH2 sense if the motor shaft rotates faster than line synchronous speed. If this happens, one of these two switches will open, depending upon the direction of rotation, and the relay winding KZ will be de-energized despite operation of the manual switches CW1-2 or CCW1-2. Accordingly, the brake winding will be de-energized and the brake will be applied so as to stop the load.

For example, the switch ZL1 detects any significant rotation in a counterclockwise direction but affects operation of the system only when clockwise rotation has been called for by operational of the manual switch SW1-2. If this switch closes during such a situation, the relay winding KA is energized causing the contacts KA1 to open, de-energizing the relay winding KZ, and applying the brake. Simultaneously, the contacts KA2 close latching up the relay winding KA until the manual switch CW1-2 is released. At the same time, the contacts KA3 de-energize the motor while the contacts KA4 illuminate an overload light OL, informing the operator of the problem. The velocity-sensing switch KL2 operates in a similar manner to detect clockwise rotation when the operation of the manual switch CCW1-2 has called for rotation in the counterclockwise direction.

As will be understood by those skilled in the art, the magnets will be rotated in synchronism by their respective stepping motors 48 when all of the motors are energized from the same line frequency source. To put all the magnets in initial angular registration, the switch SYN1-3 is operated, together with a manual switch (CW1-2 or CCW1-2) calling for rotation in one of the two possible directions. The contacts SYN1 and SYN2 permit the energization of the motors even after the respective limit switch has been contacted so that the magents can be driven up their mechanical stops. Since the motors 48 will stall when the magnets reach their mechanical limits, all of the tilting magnets can be brought up to the same initial reference position, i.e. against their respective mechanical stops. While the brake would ordinarily be fully released when rotation in either direction is called for, the switch contact SYN opens a circuit to the relay winding KS. De-energization of this relay winding opens the contacts KS1 which places a resistor RS in series with the brake solenoid 54. Thus, although the contacts KZ1 will close, the brake solenoid is only partially energized. By appropriately selecting the value of the resistor RS, the brakes can be caused to drag slightly. This dragging has been found to be advantageous in damping chattering of the magnets up against their limit stops as the motors stall and tend to chatter against the clock springs described previously.

In addition to the manual initial synchronization of the angular positions of the magnets provided as just described, the apparatus also provides for aligning of the magnets each time a load is initially lifted with the magnets in their vertical position. This operation is provided as follows. When the magnets are lowered onto a load, the chain and spring suspension will allow each magnet to come into good contact with the load even though there is some slight misalignment or warp of the load. Thus, when the magnet is energized, i.e. the switch SM is closed, each magnet will securely lock onto the load. A pair of contacts H1 and H2 are provided which are closed when the hoist which is going to lift the entire beam structure is energized to lift the beam structure with its load. This operation energizes and starts the timer KTH having a set of contacts KTH1 which are in series with a relay winding KBR. The relay KBR in turn has a set of contacts KBR1 in the circuit of the brake control relay KZ. The closure of these contacts KBR1 causes the brakes 54 to be released even though the stepping motors 48 have not been energized in either direction. This release of the brakes is momentary, however, until the time period set by the hoist timer KTH runs out, e.g. about two seconds. During this period, the magnets are securely locked onto the load and the tension is taken up on the various magnet suspensions. With the brakes off and the motors 48 de-energized, the various pivotal magnet structures will tend to come into alignment under the weight of the load, being restrained by neither the motors nor the brakes. After the short delay, the brakes are re-applied to secure the alignment thereby obtained.

After the load has been moved as desired, the motors 48 may be energized as previously described to tilt the load before setting it down. This momentary self-alignment operation is confined to situations in which a load is being initially hoisted with the magnets in their vertical or near vertical position. This restriction is provided by a pair of limit switches KL1 and KL2, one of which will be open if the magnet position departs from vertical by more than 10°.

SUMMARY OF OPERATION

In typical use, e.g. when it is desired to pick up and rotate an elongate load such as an I-beam, a normal sequence of operations will be as follows. The operator of the crane will position the magnet-carrying beam over the load, the inclination of the array along the length of the beam being controlled by the hydraulic cylinders. The lifting magnets will then be lowered down into contact with the load. As each magnet contacts the load, the supporting chains will go slack allowing the magnet to slightly orient itself into best magnetic contact with the load. The magnets themselves will then be energized to lock onto the load. At this point, lifting can commence.

Assuming that the load was picked up with the magnets in thier usual or vertical orientation, i.e. with the poles facing downwardly, the timer KTH will cause the brakes to be released during the initial lifting of the load, the motors being normally de-energized. Accordingly, as the chain suspensions for each magnet become taut, the weight of the load will tend to orient each tiltable magnet within its yoke, the yokes being supported vertically by their respective suspensions, even though there may be some twist to the load being lifted. Also, the spring suspensions at the upper ends of the magnet-supporting chains will permit the lifting apparatus to accomodate a slight warpage to the beam and thereby prevent any one magnet from having to support more than its share of the total load.

After the brief delay which re-establishes nominal alignment during each lifting operation, the brakes come back on and the load is locked in position during any lifting and transport by the crane. When the load reaches its desired location, the operator may, if desired, tilt the load, e.g. so as to permit it to be set down on a different side. To do this, the operator manually actuates the switches calling for rotation in the desired direction either clockwise or counterclockwise. As explained previously, these manual switches cause properly sequenced energization of the motor and de-energization of the brake, and subsequently, re-application of the brake in time relation to the de-energization of the motors. During rotation itself, each of the motors contributes equally to the tilting effort since they are synchronously driven by standard line frequency and the clock springs 64 effect torque sharing.

Should the operator stop the load part way during tilting to that the motor torque is inadequate to re-initiate rotation from the partially inclined position, the control circuitry of FIG. 4 senses any movement counter to the direction requested and re-applies the brake. The load must then be returned to the magnet's vertical position, i.e., the initial position, and restarted upward to tilt the load. Likewise, if the load is being swung down, it is conceivable that the torque exerted by the load may tend to overrun the motors. The circuitry of FIG. 4 also senses this condition and applies the brakes.

The circuitry of FIG. 4 also permits the operator to establish initial angular alignment or synchronization of the several magnets in the system independently of any load being lifted. As described in detail previously, this is accomplished by using the motors to run all the magnets up against their mechanical stops while manually operating the synchronization switch SYN1-3 to inhibit the operation of the limit switches.

In view of the foregoing, it may be seen that the several objects of the present invention are achieved and other advantageous results have been attained.

As various changes could be made in the above constructions without departing from the scope of the invention, it should be understood that all matter contained in the above description or shown in the accompanying drawings shall be interpreted as illustrated and not in a limiting sense.

What is claimed is:

1. Apparatus for lifting and rotating an elongate load comprising:

a plurality of electromagnets;

a corresponding plurality of yokes arranged in linear array and pivotally supporting respective ones of said electromagnets for rotation about essentially aligned axes;

a corresponding plurality of stepping motors, each of said motors being resiliently coupled to a respective electromagnet to effect torque sharing between the motors and to allow each motor to gradually engage the load during start-up to minimize stalling, each of said motors being operative to produce precise, incremental rotation of the respective electromagnet about the said aligned axes; and means for energizing said motors for synchronous operation, whereby said elongate load may be lifted by said electromagnets acting together and may be rotated essentially about its longitudinal axis.

2. The apparatus of claim 1 wherein each yoke is elongate in a direction essentially parallel to the aligned axes of rotation and wherein each end of the yoke is supported by at least three tie elements, the tie elements being skew with respect to each other in all three dimensions, thereby to reduce swinging or misalignment of the several electromagnets.

3. The apparatus of claim 2 wherein each end of the yoke is supported by four tie elements, a pair of which are fastened to points on said yoke spaced apart in opposite directions from the vertical plane of the center of gravity of said yoke, the other two tie elements being skew with respect to each other and with respect to said pair, whereby said yoke is prevented from being rotated about a horizontal axis when the elongate load is rotated and swinging or misalignment of the several electromagnets is reduced.

4. The apparatus of claim 1 wherein said yokes are suspended from a vertically compliant suspension system whereby the vertical relationship of the electromagnets can vary to accomodate warpage in the load and the electromagnets can share the weight of the load substantially equally.

5. The apparatus of claim 4 wherein said vertically compliant suspension system is a coil spring suspension system.

6. The apparatus of claim 1 including a brake for arresting rotation of each said electromagnet and means for momentarily and simultaneously disengaging each said brake during an initial lifting image stage to permit unpowered, non-synchronous rotation of the electromagnets to accomodate initial misalignment of the individual electromagnets with the load.

7. The apparatus of claim 1 including a brake for arresting rotation of each said electromagnet, means for sensing the direction of rotation of an electromagnet, and means for applying the brakes when said sensing means indicates electromagnet rotation in a direction counter to the motor drive direction.

8. The apparatus of claim 1 including a brake for arresting rotation of each said electromagnet, means for sensing an increase in the speed of a motor over the synchronous energizing speed, and means for applying the brakes when said sensing means indicates an increase in motor speed over synchronous energizing speed.

9. The apparatus of claim 1 wherein the drive shaft of each said motor is resiliently coupled by a clock spring.

10. Apparatus for lifting and rotating an elongate load comprising:

a plurality of electromagnets;

a corresponding plurality of yokes arranged in linear array and pivotally supporting respective ones of said electromagnets for rotation about essentially aligned axes, each said yoke being elongate in a direction essentially parallel to the aligned axes of rotation and being supported by tie elements at least three of which are skew with respect to each other in three dimensions, the upper ends of said tie elements being connected to a vertically compliant suspension system;

a corresponding plurality of stepping motors coupled to the respective electromagnets for precisely, incrementally rotating the electromagnets about the aligned axes, the drive shaft of each said motor being resiliently coupled to a respective lifting element to effect torque sharing;

means for energizing said motors for synchronous operation;

a brake for arresting rotation of each said electromagnet; and means for momentarily and simultaneously disengaging each said brake during an initial lifting stage to permit non-synchronous rotation of the lifting elements to accomodate initial misalignment of the electromagnets with the load, whereby said elongate load may be lifted by said elecromagnets acting together and may be rotated essentially around its longitudinal axis.

11. The apparatus of claim 10 further including means for sensing the direction of rotation of an electromagnet and means for applying the brakes when said sensing means indicates electromagnet rotation in a direction counter to the motor drive direction.

12. The apparatus of claim 10 further including means for sensing an increase in the speed of a motor over the synchronous energizing speed and means for applying the brakes when said sensing means indicates an increase in motor speed over synchronous energizing speed.

13. In an apparatus for lifting and rotating an elongate load comprising a plurality of electromagnets suspended in linear array and mounted for rotation about essentially aligned axes, each said electromagnet being coupled to a motor for supplying torque for rotating said magnets, the improvement wherein each said motor is a stepping motor adapted for synchronous operation with the other stepping motors and wherein the drive shaft of each said motor is coupled through a spring to the respective electromagnet thereby to effect torque sharing between the motors.

14. In the improved apparatus of claim 13, the further improvement comprising a brake for arresting the rotation of each said electromagnet and means for momentarily and simultaneously disengaging each said brake during an initial lifting stage to enable a small amount of unpowered, non-synchronous rotation of said electromagnets to accomodate initial misalignment of the electromagnets with the load.

15. In the improved apparatus of claim 13, the further improvement wherein each said electromagnet is mounted for rotation with respect to a yoke, each yoke is elongate in a direction essentially parallel with the aligned axes, and each said yoke is supported by at least three tie elements, the tie elements being skew with respect to each other in all three dimensions so that swinging and misalignment of the several electromagnets is reduced.

* * * * *